US011680571B2

(12) United States Patent
Blad et al.

(10) Patent No.: US 11,680,571 B2
(45) Date of Patent: Jun. 20, 2023

(54) CENTRIFUGAL PUMP UNIT AND METHOD FOR MOVING A VALVE ELEMENT IN A PUMP UNIT

(71) Applicant: GRUNDFOS HOLDING A/S, Bjerringbro (DK)

(72) Inventors: Thomas Blad, Bjerringbro (DK); Christian Blad, Bjerringbro (DK); Peter Mønster, Randers (DK)

(73) Assignee: GRUNDFOS HOLDING A/S, Bjerringbro (DK)

( * ) Notice: Subject to any disclaimer, the term of this patent is extended or adjusted under 35 U.S.C. 154(b) by 344 days.

(21) Appl. No.: 16/980,023

(22) PCT Filed: Mar. 12, 2019

(86) PCT No.: PCT/EP2019/056081
§ 371 (c)(1),
(2) Date: Sep. 11, 2020

(87) PCT Pub. No.: WO2019/175135
PCT Pub. Date: Sep. 19, 2019

(65) Prior Publication Data

US 2021/0010477 A1 Jan. 14, 2021

(30) Foreign Application Priority Data

Mar. 13, 2018 (EP) ..... 18161525

(51) Int. Cl.
*F04D 15/00* (2006.01)
*F04D 13/06* (2006.01)
(Continued)

(52) U.S. Cl.
CPC ..... *F04D 15/0016* (2013.01); *F04D 1/00* (2013.01); *F04D 13/06* (2013.01);
(Continued)

(58) Field of Classification Search
CPC ..... F04D 15/0016; F04D 1/00; F04D 13/06; F04D 13/0606; F04D 15/0005;
(Continued)

(56) References Cited

U.S. PATENT DOCUMENTS 1,955,549 A * 4/1934 Janette ..... F04D 29/042 415/24
5,924,432 A * 7/1999 Thies ..... F04D 29/448 134/198

(Continued)

FOREIGN PATENT DOCUMENTS

DE 9013992 U1 10/1991
EP 3376036 A1 9/2018

*Primary Examiner* — Peter J Bertheaud
(74) *Attorney, Agent, or Firm* — McGlew and Tuttle, P.C.

(57) ABSTRACT

A centrifugal pump assembly includes an electric drive motor (6, 8), a driven impeller (14) and a pump casing (2) which surrounds the impeller (14). A movable element (24; 24') is arranged a valve element. A section of the valve element is movable from a released position into a bearing position, fixed on a contact surface (60), by pressure which is produced by the impeller in the pump casing. A control device (64) moves the valve element from one switching position into another switching position and reduces the speed of the drive motor. Upon pressure in the pump casing dropping such that the valve element is no longer fixed on the contact surface and the valve element has been moved into the other switching position, the control device increases the speed of the drive motor again. A method for moving a valve element is provided.

22 Claims, 12 Drawing Sheets

(51) Int. Cl.

| | |
|---|---|
| ***F04D 29/02*** | (2006.01) |
| ***F24D 3/10*** | (2006.01) |
| ***F04D 1/00*** | (2006.01) |
| ***F04D 29/48*** | (2006.01) |
| ***F04D 29/42*** | (2006.01) |

(52) U.S. Cl.
CPC ..... *F04D 13/0606* (2013.01); *F04D 15/0005* (2013.01); *F04D 15/0022* (2013.01); *F04D 15/0038* (2013.01); *F04D 15/0066* (2013.01); *F04D 29/026* (2013.01); *F04D 29/4293* (2013.01); *F04D 29/486* (2013.01); *F24D 3/105* (2013.01); *F05D 2250/51* (2013.01); *F05D 2300/501* (2013.01); *F24D 2220/0207* (2013.01)

(58) Field of Classification Search
CPC ..... F04D 15/0022; F04D 15/0038; F04D 15/0066; F04D 29/4293; F04D 29/486; F04D 29/026; F24D 3/105; F24D 2220/0207; F05D 2250/51; F05D 2300/501
See application file for complete search history.

(56) References Cited

U.S. PATENT DOCUMENTS

| | | | |
|---|---|---|---|
| 2004/0071547 | A1 | 4/2004 | Elexpuru |
| 2004/0173249 | A1 | 9/2004 | Assmann et al. |
| 2017/0356449 | A1 | 12/2017 | Blad et al. |

* cited by examiner

CENTRIFUGAL PUMP UNIT AND METHOD FOR MOVING A VALVE ELEMENT IN A PUMP UNIT

CROSS REFERENCE TO RELATED APPLICATIONS

This application is a United States National Phase Application of International Application PCT/EP2019/056081, filed Mar. 12, 2019, and claims the benefit of priority under 35 U.S.C. § 119 of European Application 18 161 525.3, filed Mar. 13, 2018, the entire contents of which are incorporated herein by reference.

TECHNICAL FIELD

The present invention pertains to centrifugal pump assembly with an electric drive motor, with an impeller which is driven by this, as well as with a pump casing which surrounds the impeller.

TECHNICAL BACKGROUND

Centrifugal pump assemblies, as are applied for example as heating circulation pumps, usually comprise an electric drive motor as well as an impeller which is driven by this and which rotates in a pump casing. It is also known to integrate a valve element directly into the pump casing, wherein this valve element permits the flow through the pump assembly, produced by the impeller, to be switched between two flow paths. For this, it is known to move such valve elements by way of the flow which is created the impeller, in dependence on the rotation direction of the impeller. The disadvantage of these arrangements is the fact that a drive motor which is driveable in two directions in a targeted manner must be present. This demands suitable control electronics for activating the drive motor.

SUMMARY

With regard to this problem, it is an object of the invention to provide a centrifugal pump assembly as well as a method for activating such a centrifugal pump assembly, which permits the movement of a valve element in a simplified manner.

The centrifugal pump assembly according to the invention, which particularly preferably can be configured as a heating centrifugal pump assembly, comprises an electric drive motor as well as an impeller which is driven by this. The impeller is arranged in a pump casing, in which a movable valve element is also arranged. The valve element is arranged in the pump casing such that it is movable between two switching positions by way of a flow which is produced by the impeller, i.e. a flow of the delivered fluid. Furthermore, the valve element is configured such that at least one section of the valve element is movable from a released position into a bearing position (contacting position), in which it is fixed on a contact surface, by way of pressure or fluid pressure which is produced by the impeller in the pump casing. The contact surface can particularly preferably be an inner surface of the pump casing. When at least a section of the valve element comes to bear on this contact surface, then a frictional and/or positive engagement between the section and the contact surface results, so that these can function as a coupling which prevents a rotation of the valve element between the switching positions. The valve element can therefore be fixed or held in the inside of the pump casing in a pressure-dependent manner.

The valve element and the contact surface are usefully configured such that in the bearing position, the valve element is prevented from a movement between the switching positions due to the fixation or bearing contact of the at least one section of the valve element on the contact surface. This means that in the bearing position, the valve element cannot move between the switching positions due to the flow which is produced by the impeller. In contrast, it is securely held on the contact surface in the previously assumed position by way of the prevailing pressure. If the valve element is situated in the released position, then it is no longer fixed on the contact surface and is movable between the switching positions. This means that in the released position, it can be moved by the flow which is produced by the impeller. This means that according to the invention, the fixation of the valve element is preferably controlled in a pressure-dependent manner, whilst the movement is also effected by the flow.

The centrifugal pump assembly according to the invention further comprises a control device which serves for controlling the switching-over procedure of the valve element between the mentioned switching positions. The control device is configured in a manner such that for moving the valve element from one switching position into the other switching position, it reduces the speed of the drive motor and at a point in time when the pressure in the pump casing has dropped to such an extent that the valve element is no longer fixed on the contact surface, and the valve element has been moved into the other switching position, increases the speed of the drive motor again. As explained hereinafter, this point in time can be determined or detected in different manners. The point in time can thus be determined or detected e.g. by a time control or by way of detecting the actual switching position. Herein, a reduction of the speed can mean that the speed is only reduced to a lower speed and the pump assembly continues to run at this lower speed. Herein, the lower speed is a speed at which the impeller at the outlet side produces a pressure which lies below a limit pressure, at which the valve element can be moved into its bearing position by the pressure. I.e. the speed is so low, that the valve element or the section of the valve element remains in the released position. In order to be able hold the valve element in a certain switching position, one envisages the drive motor being activated by the control device such that drive motor is operated at a speed, at which the outlet-side pressure of the impeller is so high that the valve element is held in its bearing position by the pressure. Herein, it is particularly preferable for the control device and the drive motor to be configured such that on switching on, the drive motor reaches an adequately high speed so quickly, that a pressure which is large enough for holding the valve element in its bearing position is achieved in a direct manner before a flow which could move the valve element out of the momentary switching position is built up. I.e., a suitable matching of the drive motor, control device and valve element is selected.

According to a preferred embodiment of the invention, the control device is configured in a manner such that for moving the valve element from one switching position into another switching position, it reduces the speed of the drive motor to zero, i.e. switches off the drive motor and then, or respectively at a point in time when the pressure in the pump casing has dropped to such an extent that the valve element is no longer fixed on the contact surface and the valve element has been moved into the other switching position, switches the drive motor on again, i.e. again increases the speed of the drive motor, in particular increases it to normal operational speed. With regard to this embodiment variant, one utilizes the fact that the fluid in the peripheral region of the impeller and/or in a connected circuit continues to flow in the circuit for a certain time even after switching off the drive motor on account of its inertia, by which means the flow can therefore move the valve element on running down.

An essential feature of the present invention is the fact that the valve element is not switched from one switching position into the other switching position on starting up the drive motor, but on switching it off or running down the speed, respectively.

According to a possible embodiment of the invention, the control device can be configured in a manner such that it increases the speed of the drive motor again after a predefined time interval. I.e., according to this embodiment, the point in time for the speed increase is defined via a predefined time interval. This time interval extends between the running down of the speed or the switching-off of the drive motor and the subsequent increase of the speed or the switching-on again of the drive motor. Such a fixed time control permits a very simple configuration of the control device.

As described beforehand, according to a first possible embodiment, the switching-over can therefore be effected solely by way of time control via fixedly defined time intervals which are stored in the control device. However, with this embodiment too, it is possible to determine the points in time for switching on the drive motor again or for the speed increase, in another manner, for example via at least one position sensor which detects the actual switching position of the valve element. With such embodiment, the time intervals would not therefore be fixedly predefined, but would be detected by measuring technology. Furthermore, it is conceivable to adapt the time intervals to certain operating conditions, for example on the basis of measured values of other sensors in the system, said values being led to the control device, so that the control device can automatically define the time intervals or for example select them from a multitude of stored time intervals.

According to a possible embodiment of the invention, a position sensor can be present, said position sensor detecting the switching position of the valve element and being signal-connected to the control device, and the control device can be configured such that it increases the speed of the drive motor again when the position sensor signalises (sends a signal signals) the reaching of the desired other switching position. I.e., according to this embodiment, the point in time for switching on the drive motor again or for the speed increase is determined or detected on the basis of the actual switching position of the valve element. The point in time is reached when the position sensor detects the effected switch-over of the valve element. Such a position sensor can be formed for example by a magnet which is arranged in the valve element and whose position is detected by a magnet sensor or Reed contact. A combination of the time control and the position sensor is also conceivable, in order for example to ensure an increased reliability.

Particularly preferably, the drive motor and the control device are configured in a manner such that on starting up the drive motor, the impeller produces an adequate pressure for moving the section of the valve element into the bearing position, more quickly than a flow for moving the valve element into the other switching position. As described, the valve element can therefore be held in the reached position. Further preferably, the drive motor and the control device are configured such that on switching off the drive motor, the pressure which holds the section of the valve element in the bearing position reduces more quickly than a flow for moving the valve element into the other switching position. Preferably, the flow continues to exist for a certain time due to inertia.

According to a further possible embodiment of the invention, the control device is configured in a manner such that for switching the valve element from a first into a second switching position, it switches off the drive motor for a first predefined time interval and for switching from the second into the first switching position it switches off the drive motor for a second predefined time interval which is longer than the first time interval. This configuration is advantageous if the valve element is configured such that given a reduced speed or in the switched-off condition of the drive motor, it is moved from a first into a second switching position on account of the still remaining flow. If the pump assembly is taken into operation again in such a first time interval that the valve element is still located in the second switching position on taking into operation, then the valve element is brought into the bearing position due to the pressure increase and is fixed in the second switching position. If however the second longer time interval is selected, then the flow will also reduce and preferably reduce to such an extent that the valve element moves again into its first switching position. If, in this first switching position, the speed of the drive motor is then increased again or the drive motor switched on again, then in the first switching position the valve element is brought into the bearing position by way of the pressure increase and is fixed there for the further operation. I.e., the switching position of the valve element is set or selected via the duration of the time interval, for which the speed is reduced or the drive motor switched off.

According to a preferred embodiment, the control device and the drive motor are configured in a manner such that the drive motor is only operable in a predefined rotation direction. I.e., no such control device, via which the rotation direction could be selected, is provided. Alternatively or additionally, it can be a drive motor without a speed adjustment/setting. In particular, it can be a drive motor which is operated at mains frequency. Further preferably, the drive motor can be an asynchronous motor. The invention has the advantage that it can hence be realized with conventional, comparatively simply constructed drive motors without complicated control or regulation electronics, respectively.

However, it is alternatively possible for the centrifugal pump assembly to comprise a control device, via which the speed of the drive motor can be changed, for example in order to be able to realize a reduction of the speed without a complete switching-off of the drive motor. For this, the control device in particular can comprise a frequency converter, via which the drive motor is operated.

According to a further possible embodiment of the invention, the pump casing comprises at least one connection, preferably at least two connections and the valve element is configured in a manner such that in its at least two switching positions, it opens at least one flow path through the at least one connection to a differently wide extent. If two connections are present, then these two connections are opened to a differently wide extent in the at least two switching positions. A mixing ratio between the two connections can be varied by way of this. Alternatively or additionally, a switching of the flow path between the two connections is particular preferably realized. Herein, the two connections can lie at the delivery side or the suction side of the centrifugal pump assembly.

The valve element is thus particularly preferably configured such that in a first switching position, it releases a flow path through a first connection and in a second switching position it releases a flow path through a second connection. Herein, in the first switching position, the flow path through the second connection is preferably closed, whereas in the second switching position the flow path through the first connection is closed.

According to a further possible embodiment of the invention, the valve element is rotatably mounted in the pump casing in a manner such that it is rotatingly movable between the switching positions, wherein the valve element in the pump casing is preferably rotatably mounted about a rotation axis which extends parallel and further preferably in a manner aligned to a rotation axis of the impeller. Particularly preferably, the valve element extends with a wall or surface parallel to the face side of the impeller and/or peripherally around the impeller. The rotational movability of the valve element permits a simple adjustment of the valve element, since the valve element can be moved by an annular flow which forms in the peripheral region of the impeller on its rotation. The annular flow acts upon the rotatingly mounted valve element in particular via friction forces. For this, the valve element with at least one wall is adjacent to a delivery chamber which surrounds the impeller.

The valve element thus preferably comprises at least one flow engagement surface, upon which the flow which is produced by the impeller acts for moving the valve element, wherein the flow engagement surface preferably delimits flow chamber or delivery chamber which surrounds the impeller. One succeeds in the flow resistance in the centrifugal pump assembly not being significantly increased due to the fact that the flow engagement surface forms a delimitation wall of the flow space, since a delimitation wall of the flow space which is present in any case is now formed by the valve element. The flow engagement surface is preferably shaped such that the flow can exert a force upon the wall, in particular parallel to the extension direction of the wall, in order to move the wall and hence the valve element, with the flow. Structurings or projections can possibly be provided on the flow engagement surface for this, in order to permit an improved force action of the flow upon the valve element.

Particularly preferably, the valve element comprises a restoring means or a restoring element. Such a restoring means can be configured for example in the form of a spring, a magnet and/or a weight. The restoring means is preferably configured such that given a standstill of the impeller when no flow acts upon the valve element it moves the valve element into a predefined switching position. This for example can be the first switching position. By way of such a restoring means, on switching off the drive motor when the valve element has moved into its released position, one succeeds in the valve element always automatically moving into a predefined initial position, specifically the mentioned predefined switching position, on account of the restoring means. Even if the drive motor can only be driven in one rotation direction, despite this, one succeeds in the valve element being able to be moved back in the opposite direction of rotation by way of this. The movement in the opposite direction of rotation is then effected by the restoring means. The restoring via such a restoring element is further preferably realized in combination with the aforementioned time control for the switch-over procedures. The use of a restoring element permits the restoring of the valve element in a known time interval, so that via the predefined time interval, the point in time, at which the drive motor must be switched on again or the speed increased again can be determined in the control device.

According to a further possible embodiment of the invention, a force generating means, preferably a spring is present, said means subjecting the valve element or its at least one section to a force out of the bearing position into the released position. Given a reduction of the pressure in the peripheral region of the impeller, the force generating means thus has the effect of moving back the valve element into the released position. If the pressure which is produced by the impeller and acts upon the valve element exceeds a limit value, at which the force of the force generating means is exceeded, then the valve element moves against the force of the force generating means into the bearing position An automatically releasing coupling is therefore created between the valve element and a contact surface. In the case of only one section of the valve element being movable, given an elastic configuration of this section, an elastic restoring force which is produced in the section itself can also serve as a force generating means which moves the valve element back into its initial position.

The force generating means and the drive motor are preferably matched to one another. As described, an adequate pressure is necessary in order to succeed in the valve element being moved against the force generating means into its bearing position. So as to be able achieve this rapidly, the drive motor preferably comprises a correspondingly adapted start-up behavior, in order, in the aforementioned manner, to reach this pressure in such a rapid manner that a flow which is sufficient in order to move the valve element into another switching position is not yet built up. Conversely, the force generating means, in particular a spring, is configured such that it musters an adequately large force, in order, given a pressure drop, to move the valve element as quickly as possible again into its released position and in this position to ensure the movability of the valve element between the switching positions.

According to a further possible embodiment of the invention, the control device comprises as least one signal input or sensor, from which the control device can receive at least one switching signal. The control device is further preferably configured such that on receiving the switching signal, it controls the drive motor such that the valve element is moved from one switching position into the other switching position. Particularly preferably, the control device is configured such that its then switches the drive motor off and on again for the time intervals which are described above, in order to achieve the desired switching position. The signal input can be configured in a wire-connected or wireless manner, for example as a radio interface. A signal cable can be led through a suitable opening or via a suitable connection plug into the inside of an electronics housing, in which the control electronics are arranged. Particularly preferably, a signal cable could be led through the same opening, through which an electric connection cable is led into the electronics housing or into a terminal box. If the control device comprises a sensor, then this sensor can be configured to detect an event such as for example a flow in a conduit, on account of which a switch-over of the switching position is desired. This is the case for example in heating facilities, in which, apart from the temperature control of a building, the heating of service water is also to be effected. If a service water flow is detected in such a heating facility, then a switch-over of a switch-over valve, for example of the valve element according to the invention is necessary, in order to open a flow path through a heat exchanger for heating the service water.

Particularly preferably, the control device can be arranged in an electronics housing, and a sensor for producing the switching signal can be arranged in the electronics housing, wherein the sensor is a magnet sensor which can detect the displacement of a magnetic field which is produced outside the electronics housing. Concerning such a configuration, a flow sensor which comprises a moving magnet can be placed directly in the proximity of the electronics housing or terminal box, such that a movement of the magnet can be detected by the magnet sensor. A contact-free signal transmission into the inside of the electronics housing can be therefore be achieved. Moreover, one can use a conventional electronics housing or a conventional terminal box which requires no additional opening, in order to lead the signal of a flow sensor to a control device which is arranged in the inside of the electronics housing.

Hence the valve element in the bearing position is usefully fixed on the contact surface and hence is secured against movement, whereas in the released position it is movable between the switching positions by the flow which is produced by the impeller. The flow which is produced by the impeller is therefore used for moving the valve element, whereas the force which is produced by the impeller is used for fixing the valve element in a switching position.

Apart from the aforementioned centrifugal pump assembly, the subject-matter of the invention is a method for moving a valve element which is arranged in a centrifugal pump assembly. Herein, in particular it is the case of a centrifugal pump assembly according to the preceding description. With regard to preferred features of the method therefore, the preceding description of the centrifugal pump assembly is also referred to. The method steps which are described in combination with the centrifugal pump assembly are likewise preferred embodiments of the subsequently described method.

The method according to the invention, for moving a valve element in a centrifugal pump assembly, is envisaged for use with a valve element which is arranged and configured such that it is movable from a one switching position into a second switching position by a flow which is produced by an impeller of the centrifugal pump assembly. Moreover, at least one section of the valve element, particularly preferably the complete valve element, is movable from a released position into a bearing position, in which it is fixed on a contact surface, by way of pressure which is produced by the impeller. In the released position, the valve element is movable between the switching positions, whereas in the bearing position it is fixed in a switching position against movement into the other switching position.

The method according to the invention comprises two essential steps. In a first step, the speed of the drive motor is reduced or the drive motor is completely switched off, by which means the pressure at the outlet side of the impeller is reduced to such an extent that the valve element or the at least one section of the valve element is no longer fixed in the bearing position, but gets into the released position. As described above, this can be achieved preferably by way of a force generating means which acts upon the valve element or its described section. In the released position, the valve element is moved out of the first into the second switching position by way of the flow which is produced by the impeller. As described above, this is preferably effected by way of the rotation of the valve element. In a second step, the speed of the drive motor is then increased again or the drive motor is switched on again, so that the pressure at the outlet side of the impeller is increased to such an extent that the valve element or its at least one section moves into the bearing position and is fixed there by way of the pressure. I.e., after switching the drive motor on again, the valve element is therefore fixed in the previously reached switching position by way of the bearing contact of the valve element on a contact surface. The point in time of switching on the drive motor again or for increasing the speed can be determined in the manner which has been described above by way of the device.

According to a preferred embodiment of the method, for moving the valve element out of the second switching position into the first switching position, the drive motor is switched off until the flow at the outlet side of the impeller has dropped off. In this condition, the valve element can be moved back into the first switching position by a restoring element as has been described above. This is preferably a movement counter to a movement direction which is caused by the flow on operation of the drive motor. The drive motor is subsequently put into operation such that pressure builds up at the outlet side of the impeller, said pressure moving the valve element or its at least one section into the bearing position, before a flow which would move the valve element into the second switching position builds up. I.e., the drive motor is started up so rapidly, that such a high pressure is built up in a direct manner that the valve element gets into the bearing position, before it can be moved out of the reached switching position. The drive motor is switched off for a shorter time interval or the speed is reduced for a shorter time interval, in order to move the valve element out of the first into the second switching position. Herein, this is a time interval which has such a duration that a flow which can move the valve element into the second switching position remains on account of the inertia of the fluid. As described above, the time intervals can be fixedly set or it is possible to determine the end points in time of the time intervals for example by way of detecting the reached switching position of the valve element. The above description is referred to with regard to this. After reaching the second switching position, the drive motor is brought into operation or the speed of the drive motor is increased, before the flow dies down and the valve element can move back again into the first switching position. Such a high pressure is built up in the second switching position by way of this that the valve element preferably gets into the bearing position again. The drive motor can then be continued to be driven in this position, for normal operation of the centrifugal pump assembly.

The invention is hereinafter described by way of example and by way of the attached figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF PREFERRED EMBODIMENTS

Figure 12:
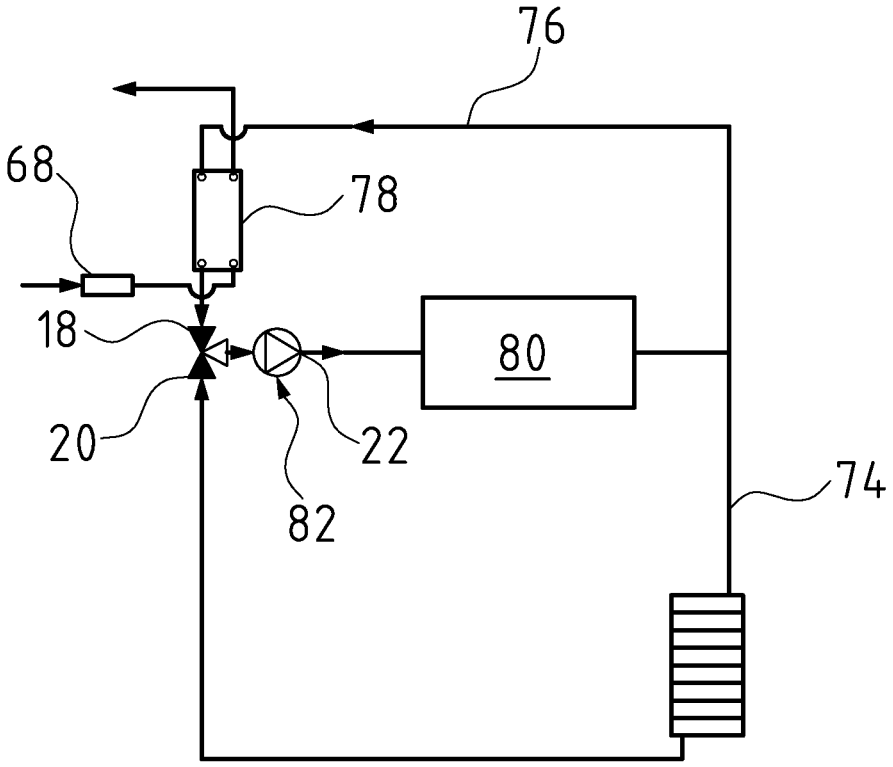
FIG. 12 is a schematic circuit diagram of a heating facility with a centrifugal pump assembly according to FIGS. 1 to 11.

Referring to the drawings, a centrifugal pump assembly which is shown in FIGS. 1 to 11 is provided for installation into a hydraulic block, i.e. into a hydraulic construction unit for a heating facility, in particular a compact heating facility as is schematically shown in FIG. 12. The centrifugal pump assembly comprises a pump casing 2 with a motor casing 4 which is attached to this. In the known manner, an electrical drive motor, consisting of a stator 6 and a rotor 8 is arranged in the motor housing 4. The shown drive motor is configured as a wet-running electrical drive motor, concerning which the rotor space, in which the rotor 8 rotates, is separated from the surrounding stator space, in which the stator 6 is situated, by way of a can pot or can 10. The rotor 8 is connected to an impeller 14 in a rotationally fixed manner via a rotor shaft 12. A terminal box 16 which contains the electric connections as well as necessary electric and electronic components for activating the drive motor is arranged on the outer side of the motor housing 4.

The pump casing 2, in which the impeller 14 rotates, comprises two suction connections 18 and 20, as well as a delivery connection 22. A rotatable valve element 24 which in this embodiment example is configured in a drum-like manner is arranged in the inside of the pump casing 2. The valve element 24 serves for selectively creating a flow connection from one of the suction connections 18, 20 to the suction port 26 of the impeller 14.

The valve element 24 is formed by a pot-like lower part 28 and a cover 30. Both are fixedly connected to one another. The cover 30 centrally comprises an opening with an annular collar, said collar forming an inlet branch or stub 32 which engages into the suction port 26 of the impeller 14. The lower part 28 is fastened on a bearing sleeve 34. This sleeve could also be configured as one piece with the lower part.

Figure 6:
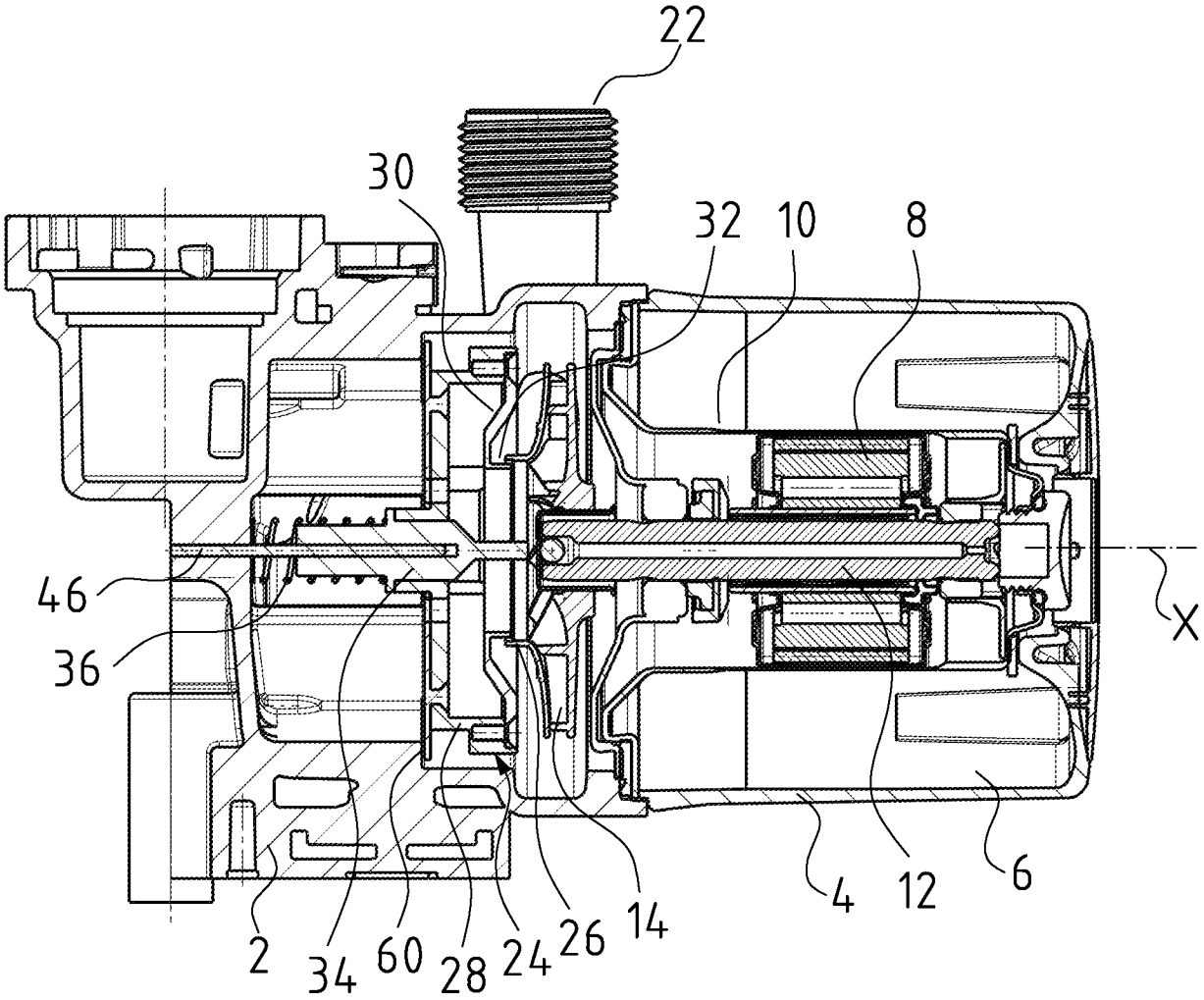
FIG. 6 is a sectioned view of the centrifugal pump assembly according to FIG. 5, along the line A-A in FIG. 5, with the valve element in a bearing position.
Figure 7:
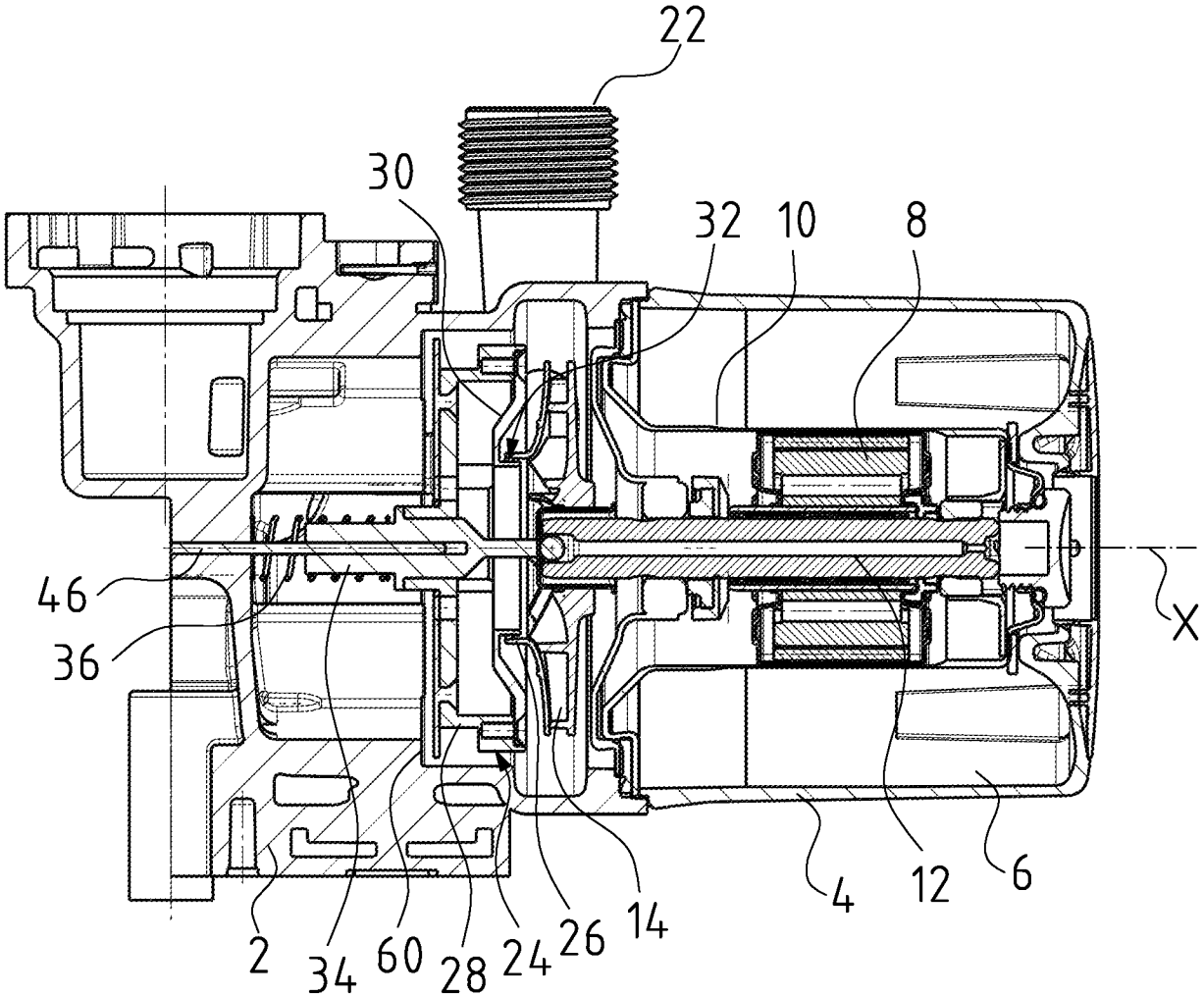
FIG. 7 is a sectioned view according to FIG. 6 with the valve element in a released position.
Figure 8:
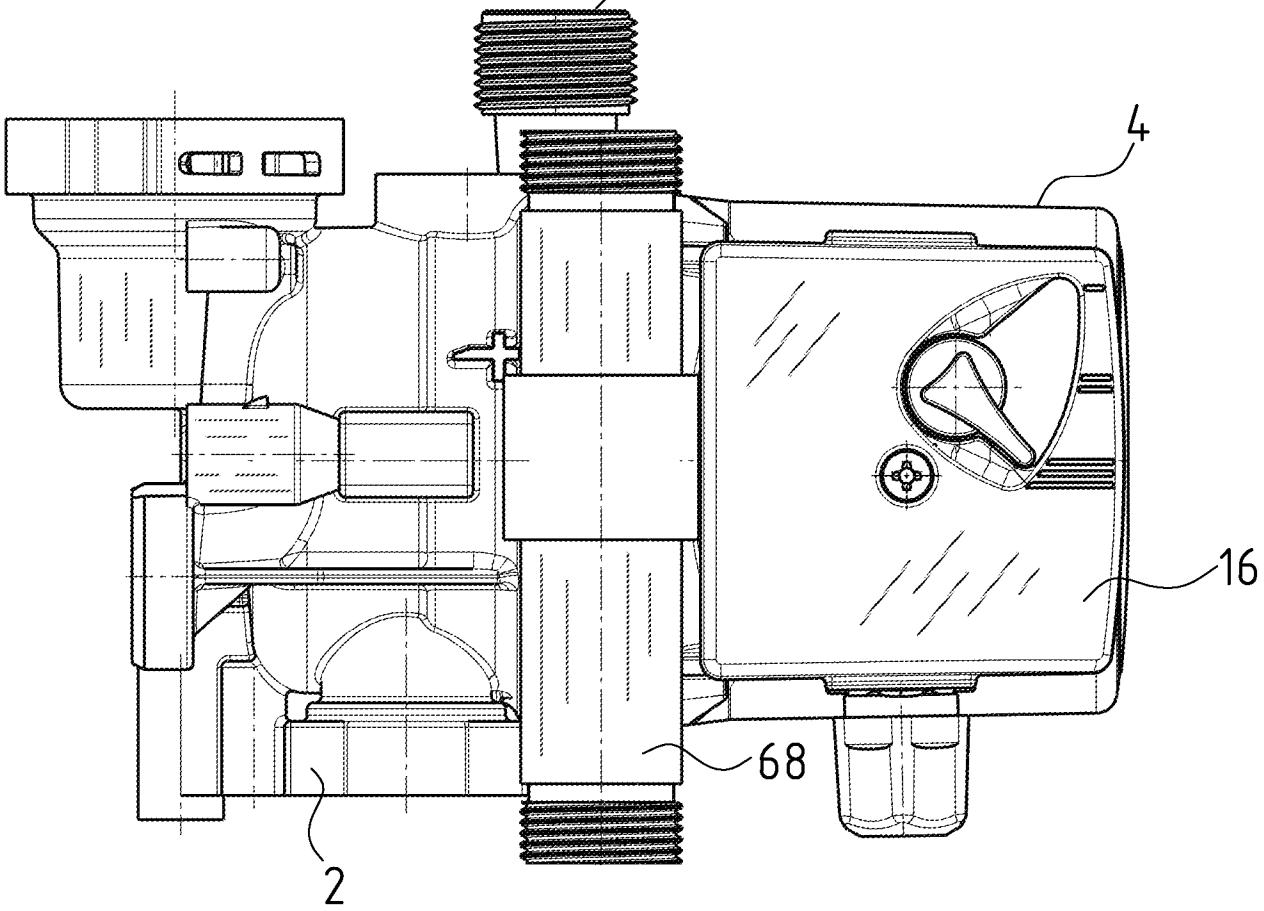
FIG. 8 is a lateral view of the centrifugal pump assembly according to FIGS. 1 to 7.

The bearing sleeve 34 is supported on the base of the pump casing 2 via a spring 36 which is configured as a compression spring. The spring 36 hence presses the valve element 24 into the released position which is shown in FIG. 7. The bearing sleeve 34 is moreover rotatably mounted on a bearing bolt 46 which, departing from the base extends in the direction of the longitudinal axis X into the inside of the pump casing 2. The bearing bolt 76 engages into a hole which in the bearing sleeve 34 extends in the longitudinal direction, so that the bearing sleeve 34 is slidingly mounted on the bearing bolt 46. The bearing bolt 46 is firmly fixed in the base of the pump housing 2. Apart from the rotational movement, the bearing sleeve 34 can also slide on the bearing bolt 46 in the longitudinal direction X when the valve element 24 is displaced from the released position which is shown in FIG. 7, into the bearing position which is shown in FIG. 6. The mounting of the bearing sleeve 34 on the bearing bolt 46 in this embodiment permits a rotation movement as well as an axial movement.

Figure 1:
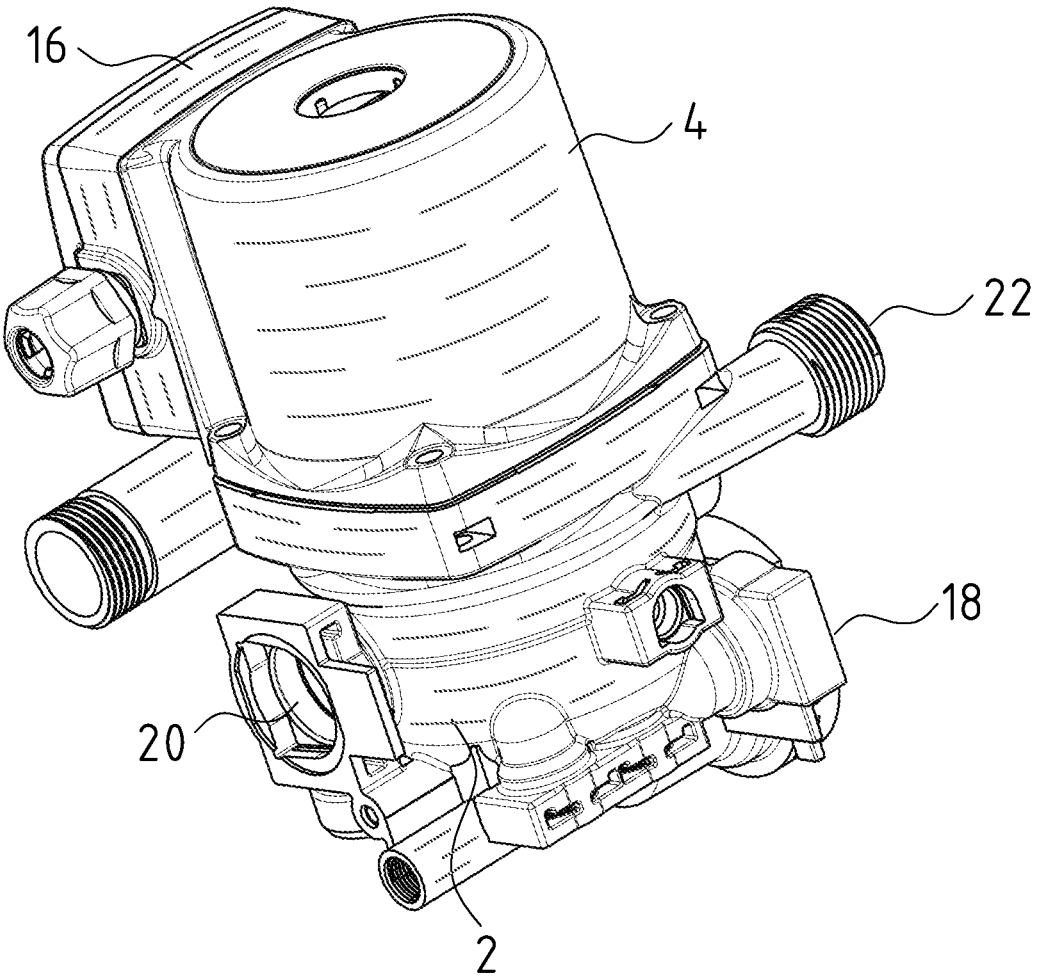
FIG. 1 is a perspective view of a centrifugal pump assembly according to the invention.
Figure 2:
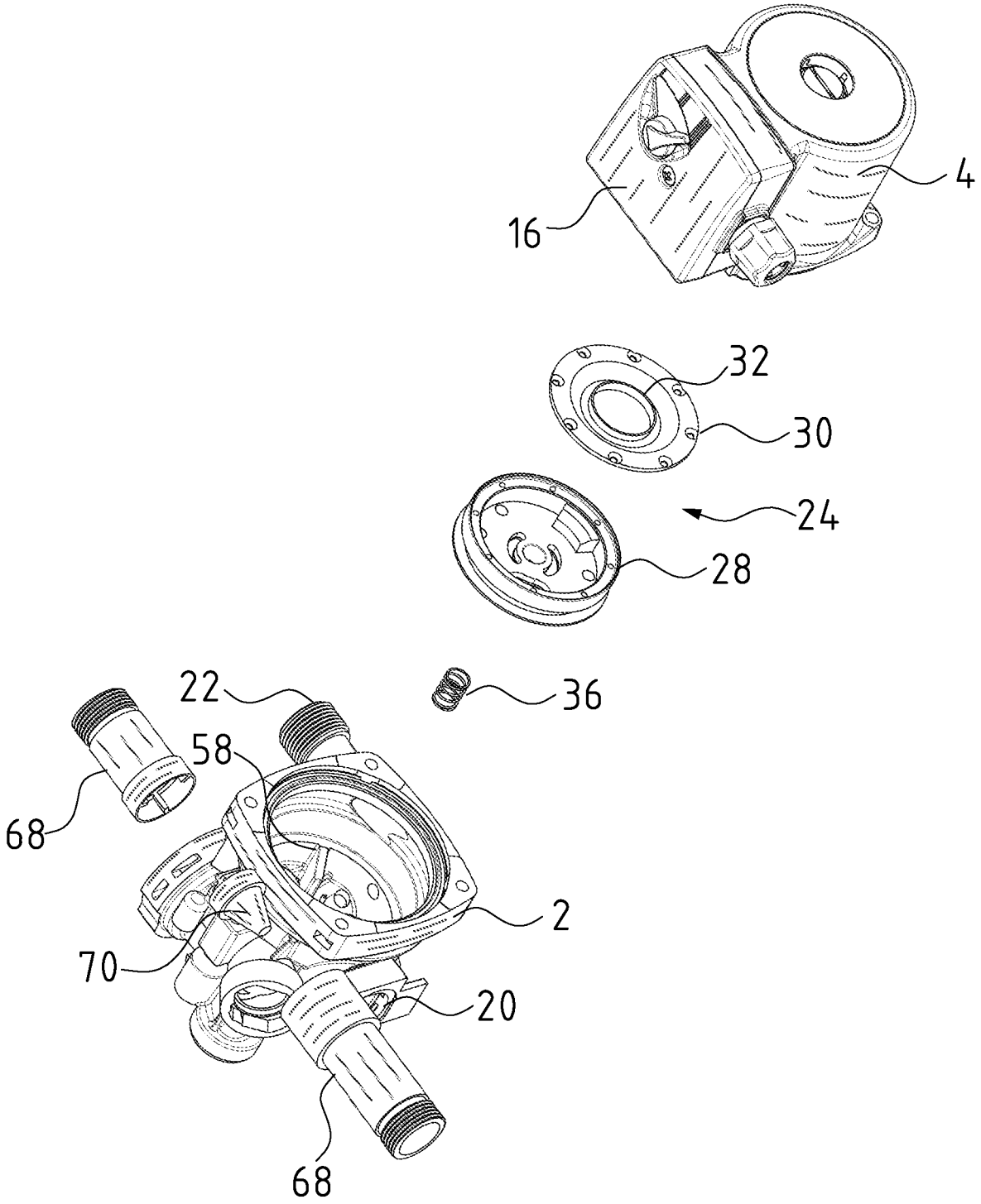
FIG. 2 is a perspective exploded view of the centrifugal pump assembly according to FIG. 1.
Figure 3:
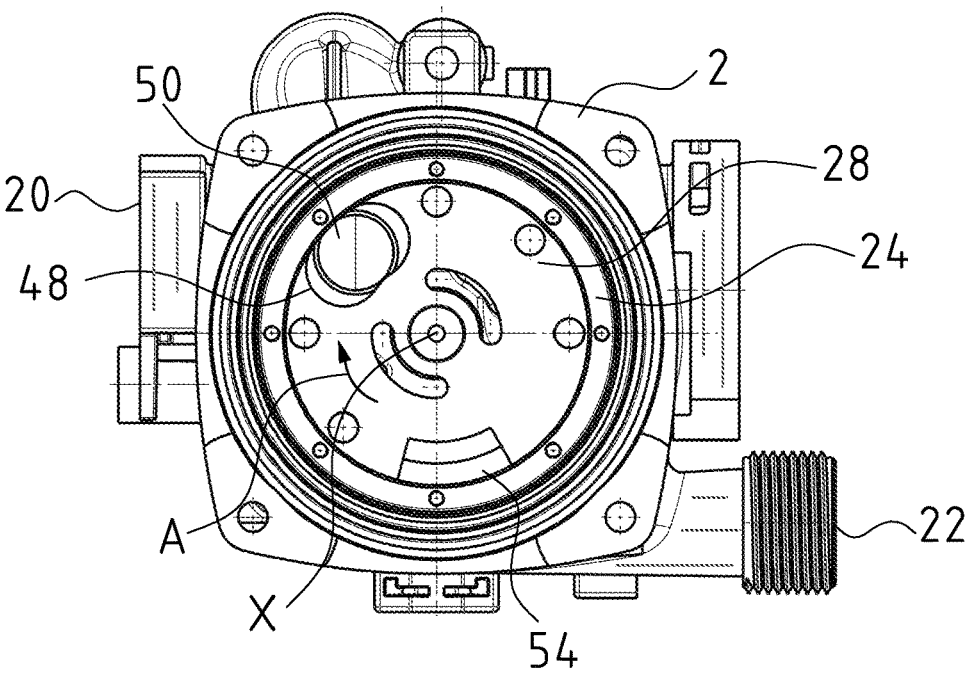
FIG. 3 is a plan view upon the opened pump casing of the centrifugal pump assembly according to FIGS. 1 and 2, with a valve element in a first switching position.
Figure 4:
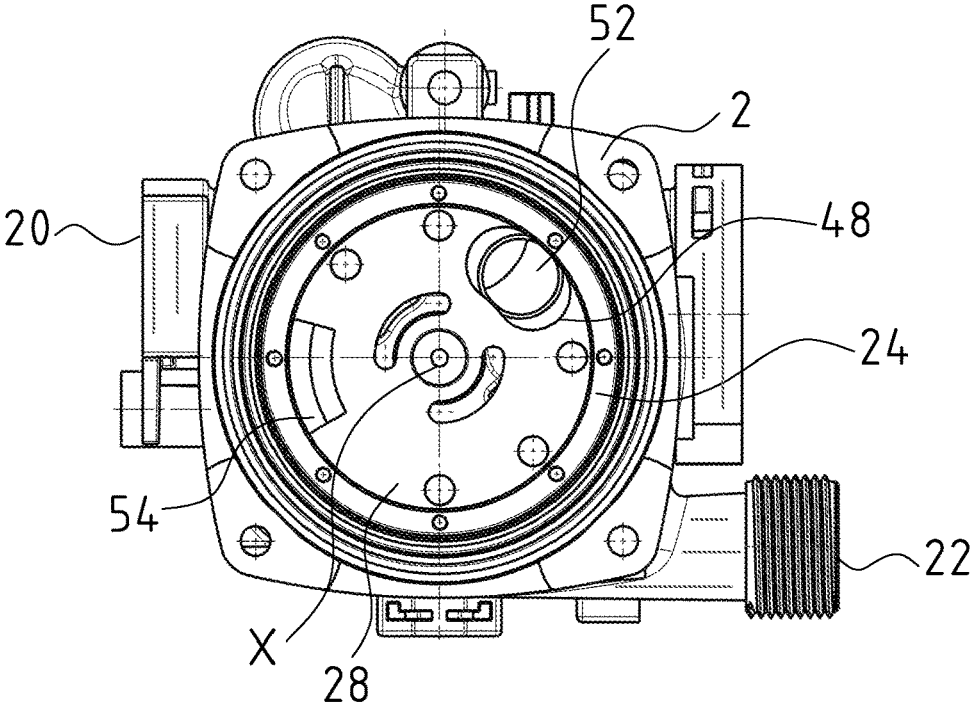
FIG. 4 is a view according to FIG. 3, with the valve element in a second switching position.
Figure 5:
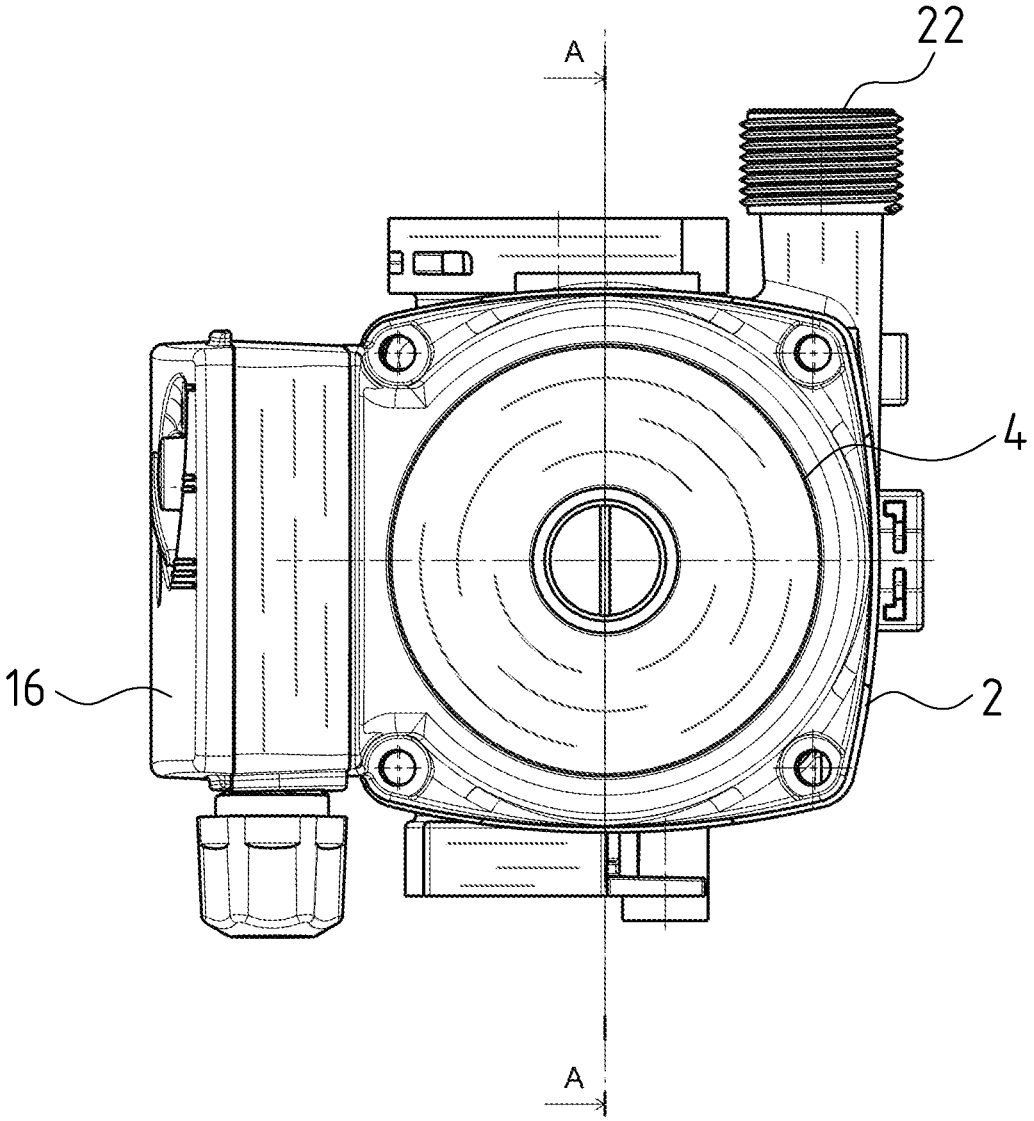
FIG. 5 is a plan view upon the face side of the centrifugal pump assembly according to FIGS. 1 to 4.

The valve element 24 in its lower part 28 comprises a switching opening 48 as can be seen in FIGS. 3 and 4. The cover 30 is removed in the representations in FIGS. 3 and 4. The switching opening 48 lies in the base surface of the lower part 28 which extends transversely to the longitudinal or rotation axis X. The switching opening 48 herein lies radially distanced to the rotation axis X, so that it moves into another angular position on rotation of the valve element 24 about the rotation axis X on an arcuate path. FIG. 3 shows the first switching position of the valve element 24, at which switching position the switching opening 48 overlaps an inlet opening 50 in the base of the pump casing 2. The inlet opening 50 is in flow connection with the suction connection or suction branch 20. In the second switching position of the valve element which is shown in FIG. 4, the switching opening 48 overlaps with the inlet opening 52 which is in flow connection with the suction connection 8. Furthermore, a restoring element in the form of a weight 54 is arranged or formed on the base of the lower part 28. The weight 54 is likewise arranged in a manner distanced to the rotation axis X, so that it can produce a torque about the rotation axis X. The weight 54 is placed such that in the first switching position which is shown in FIG. 3, it lies at the bottom in the represented, envisaged installation position of the pump assembly. The rotation axis X is always extends horizontally in the case of the specified installation position. If the valve element 24 is rotated into the second switching position which is shown in FIG. 4, then the weight 54 is lifted, so that a restoring torque is produced upon the valve element 24, and this seeks to move the valve element 24 back into the first switching position.

The valve element 24 on its outer side comprises a stop element 56 in the form of a projection or rib, which extends away from the base 28 in a manner parallel to the longitudinal axis X. This stop element 56, in the second switching position which is shown in FIG. 4, comes into contact with a second stop element 58 in the form of a firm rib in the inside of the pump casing 2. The rotation movement of the valve element 24 is therefore limited, so that it cannot be rotated beyond the second switching position which is shown in FIG. 4.

Apart from the movement between the two switching positions, the valve element 24, as specified, can carry out an axial movement along the longitudinal axis X, as is shown in FIGS. 6 and 7. In FIG. 6, the valve element 24 is situated in a bearing position, in which it is pressed into bearing contact with the pump casing 2 by way of the outlet-side pressure which is produced by the impeller 14. The pressure which is produced by the impeller 14 acts upon the surface of the cover 30 which faces the impeller. The suction-side pressure of the centrifugal pump assembly acts on the rear side of the cover 30, in the inside of the valve element 24. A differential force which acts against the spring 36 therefore results, and, if the pressure is adequately high, presses the valve element 24 into the bearing position which is shown in FIG. 6. Herein, the lower part 28 comes into sealing contact on an annular shoulder 60 in the inside of the pump casing. The suction side is therefore sealed with respect to the delivery side by way of the valve element 24, and the valve element 24 is moreover fixed in the pump casing 2 in a non-positive manner, so that it cannot be rotated between the switching positions. If the speed of the drive motor and thus of the impeller 14 is reduced or the impeller 14 is at a standstill, then the fluid pressure which acts upon the cover 30 reduces, so that the pressure force reduces and the spring force of the spring 36 exceeds this pressure force again. In this condition, the valve element 24 moves into the released position which is shown in FIG. 7 and in which the lower part 28 of the valve element 24 lifts from the shoulder 60, is thus no longer non-positively held on the base of the pump casing 2 and can rotate freely between the switching positions. The spring 36 and the drive motor are matched to one another such that the drive motor produces a pressure which permits the force of the spring 36 to be overcome for displacing the valve element 24. The spring is simultaneously dimensioned such that when the pressure drops below a certain limit value, the valve element 34 can move into the released position which is shown in FIG. 6.

Figure 9:
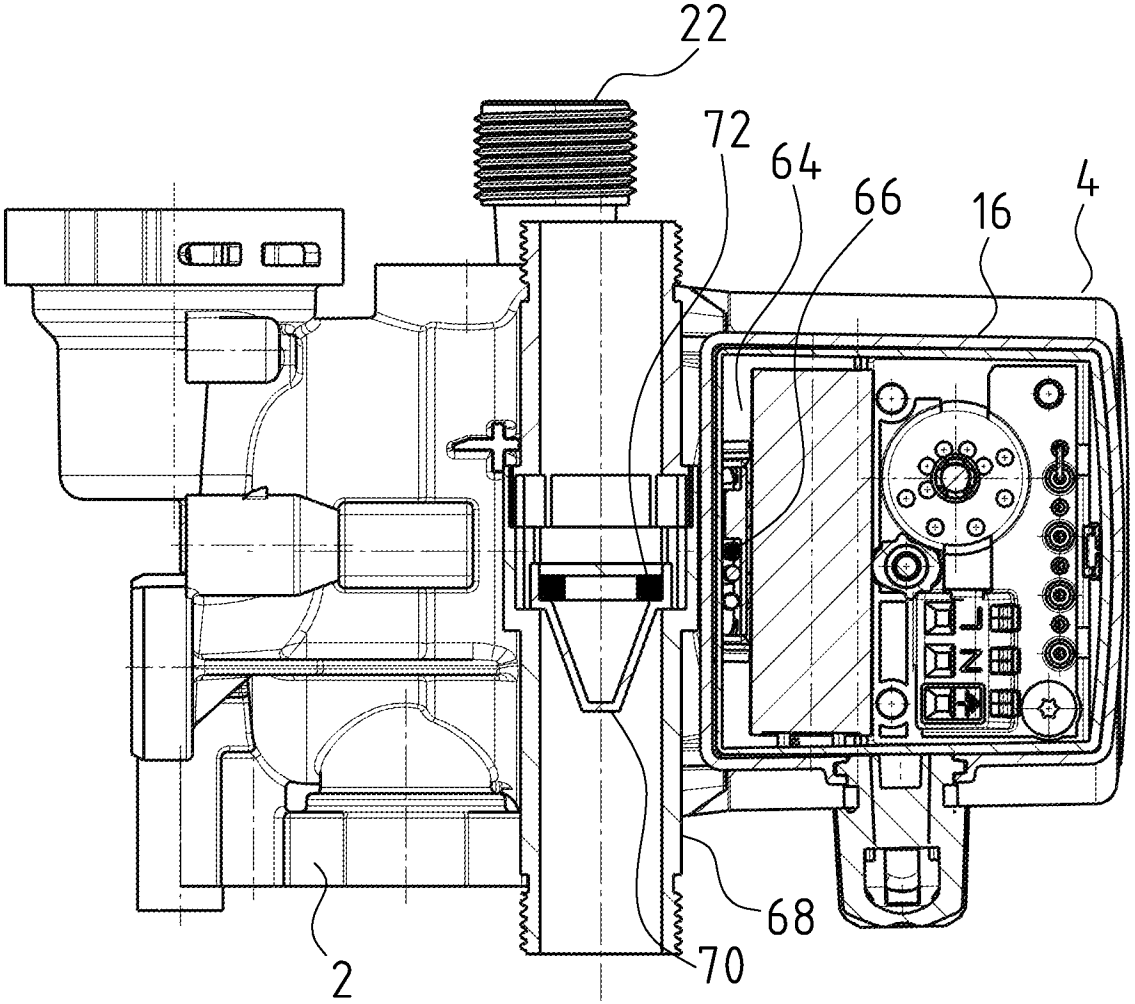
FIG. 9 is a sectioned view of the centrifugal pump assembly according to FIG. 8 with a flow sensor in a first position.
Figure 10:
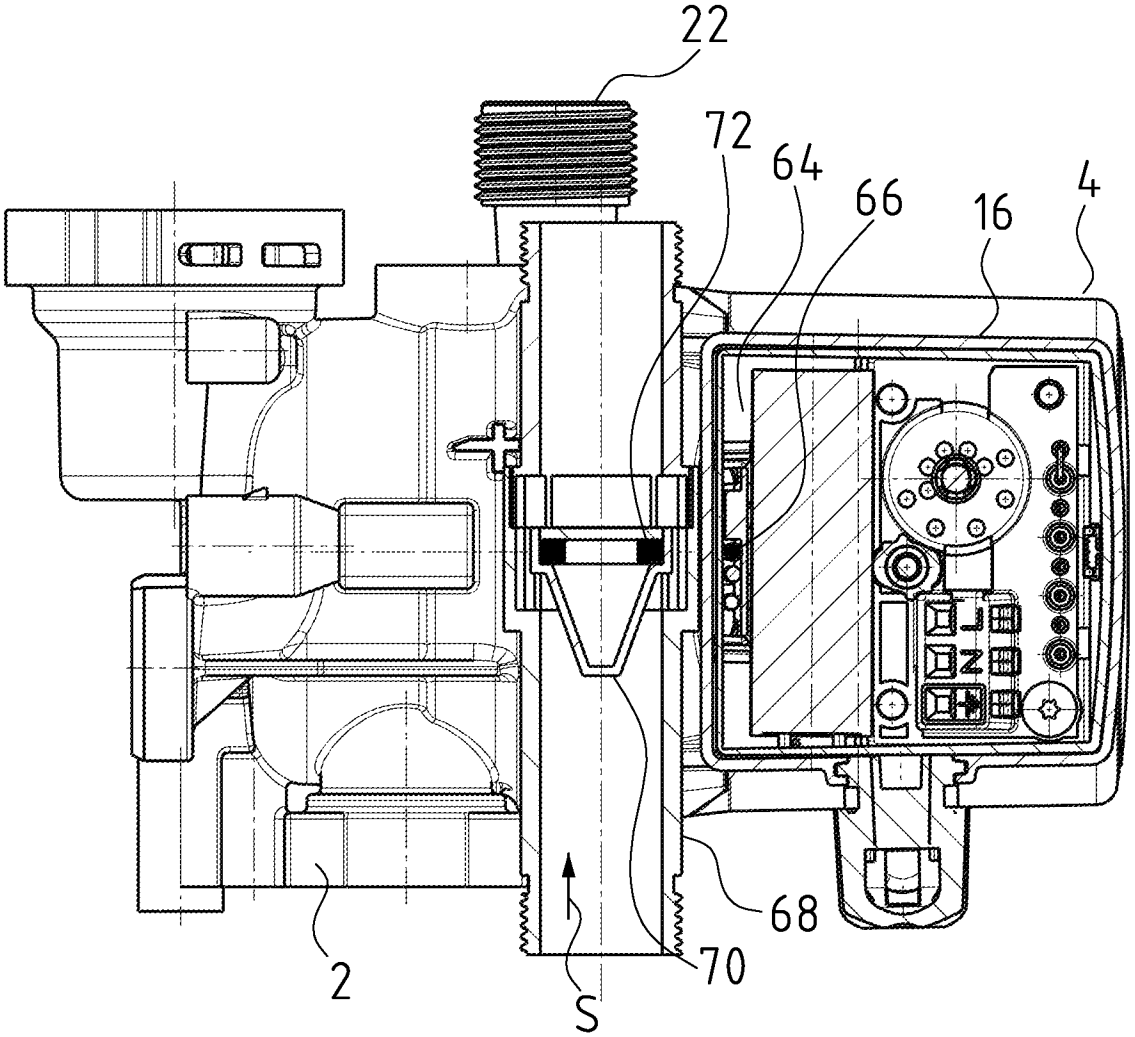
FIG. 10 is a sectioned view according to FIG. 9 with a flow sensor in a second position.
Figure 11:
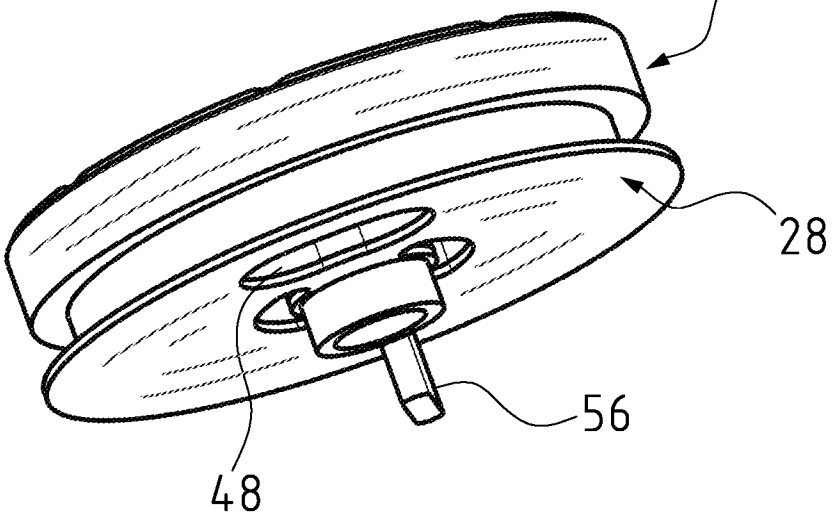
FIG. 11 is a perspective view of the valve element 24 of the centrifugal pump assembly according to FIGS. 1 to 10.

As is shown in FIGS. 9 and 10, control electronics 62 which control the switching procedure by way of rotating the valve element 44 are located in the inside of the terminal box 16. Concerning the drive motor which is shown here, it is the case of a conventional unregulated asynchronous motor which is not activated via a frequency controller. I.e., an electronic speed change is not envisaged. In contrast, the control electronics 64 are preferably merely configured such that they can switch off the drive motor for certain time intervals in a targeted manner. The switching procedure of the valve element 24 is merely effected by way of switching off the drive motor for predefined time intervals. The switching position of the valve element 24 could also be detected instead of a pure time control, in order to determine or define the end of the respectively required time interval.

In the initial position, the valve element 24 is situated in the first switching position which is shown in FIG. 3, since the weight 54 automatically rotates the valve element 24 into this position. The drive motor is configured such that when it is switched on, such a high pressure directly builds up in the peripheral region of the impeller 14 that the valve element 24 is pressed into the bearing position which is shown in FIG. 6 and is non-positively held in this position. I.e. in this condition, the impeller delivers fluid into the delivery connection 22 via the suction connection 20. If the control electronics 64 now switch off the drive motor for a short time interval which is selected such that the pressure in the peripheral region of the impeller 14 reduces to such an extent that the valve element 24 is moved by the spring 36 into the closed position, then the valve element 24 can be rotated into the shown second switching position. This is effected since the flow in the peripheral region of the impeller 14 and possibly in a connected hydraulic system does not immediately disappear, but a flow still remains in the pump casing for a certain time duration on account of the inertia of the delivered fluid. This flow acts upon the valve element 24, so that this is co-rotated with the flow in the rotation direction A, until the stop element 56 comes to abut on the second stop element 58 and the switching opening 48 covers the inlet opening 52. The control electronics 64 now switches the drive motor on again, by which means such a pressure is built up in a direct manner that the valve element 24 is pressed again into the bearing position, wherein the inlet opening 50 is closed by the base of the lower part 28. In this condition, the impeller 14 delivers fluid to the delivery connection 22 via the suction connection 18.

The control electronics 64 switch off the drive motor for a second longer time interval in order to move the valve element 24 out of this second switching position into the first switching position again. This time interval is selected such that not only does the pressure in the peripheral region of the impeller 14 reduce, but also the annular flow dies down to such an extent that the torque which is created by the weight 54 becomes greater and the valve element 24 can rotate back again into its first switching position. Thereafter, the drive motor can then be taken into operation again, so that the valve element 24 is held in this switching position by way of the direct pressure build-up. For this switching procedure too, the control device can select a pure time control. Here too, it is alternatively possible to actually detect the switching position of the valve element 24.

In this embodiment example, the control electronics 64 comprise a magnet sensor 66 which is situated close to the outer wall of the terminal box 16. This can produce a signal which initiates the control electronics 64 into switching over the switching positions. In this embodiment example, a pipe element 68, in which a movable sensor body 70 is arranged for detecting a flow is arranged on the outer side of the terminal box 16, close to the wall, on which the magnet sensor lies 66. If no flow runs through the pipe element 68, then the sensor body 70, held for example by a spring element, is located in the idle position which is shown in FIG. 9. A magnet 72 is arranged in the sensor body 70. In the idle position which is shown in FIG. 9, the magnet 70 does not lie opposite the magnet sensor 66 which for example can be a Reed contact. If now a flow arises in the pipe element 68 in the direction of the arrow S, then the sensor body 70 is displaced into the position which is shown in FIG. 10, by which means the magnet 72 comes into a position lying opposite the magnet sensor 66. The magnet sensor 66 detects the magnetic field of the magnet 72 and outputs a switching signal which can initiate the valve element 24 into switching over.

The described centrifugal pump assembly can be applied for example in a heating system as is shown in FIG. 12. The heating system comprises two circuits, a heating circuit 74 which serves for heating a building, as well as a circuit 76 through a secondary heat exchanger 78 for heating service water. The heating circuit 74 as well as the second circuit 76 branch from an outlet of a primarily heat exchanger 80, said heat exchanger for example able to be formed by a gas heater. A centrifugal pump assembly 82 which corresponds to the preceding centrifugal pump assembly is arranged at the inlet side of the primary heat exchanger 80. The heat transfer medium flows into the primary heat exchanger 80 from the delivery connection 22 of the centrifugal pump assembly 82. The return of the heat circuit 74 is connected to the suction connection 20, whereas the return from the secondary heat exchanger 78 is connected to the suction connection 18. The described pipe element 68 with the flow monitor which is formed by the sensor body 70 lies in a flow path for the service water which is to be heated. If the centrifugal pump assembly is taken into operation in the first switching position, as described above, then it delivers the heat transfer medium in the circuit through the primary heat exchanger 80 and the heating circuit 74. If now service water flows through the pipe element 68, this leads to the described displacement of the sensor body 70, by which means the control electronics 64 recognizes a demand for the service water heating. This initiates the control electronics 64 into switching off the drive motor for a first shorter time interval, so that the valve element 24 rotates into the second switching position which is shown in FIG. 4. In this switching position, the control electronics 64 bring the drive motor back into operation after the completion of the time interval, so that the centrifugal pump assembly 82 then delivers the heat transfer medium through the second circuit 76 from the primary heat exchanger 80 through the secondary heat exchanger 78. If the centrifugal pump assembly is switched off again for a longer, i.e. second possible time interval by way of the control electronics 64 when there is no longer a demand for service water heating, then the valve element 24 moves back into the first switching position on account of gravity.

A safety function which can prevent an overheating of the primary heat exchanger 80 can also be realized by this arrangement. If for example, in the heating circuit 74, all radiators valves are closed and heat is no longer taken, then this can be recognized by a temperature sensor. If, in this condition, the centrifugal pump assembly 82 is now briefly switched off, then the valve element 24 moves again into the second switching position. A circulation via the secondary heat exchanger 78 can then be maintained in this second switching position.

Figure 13:
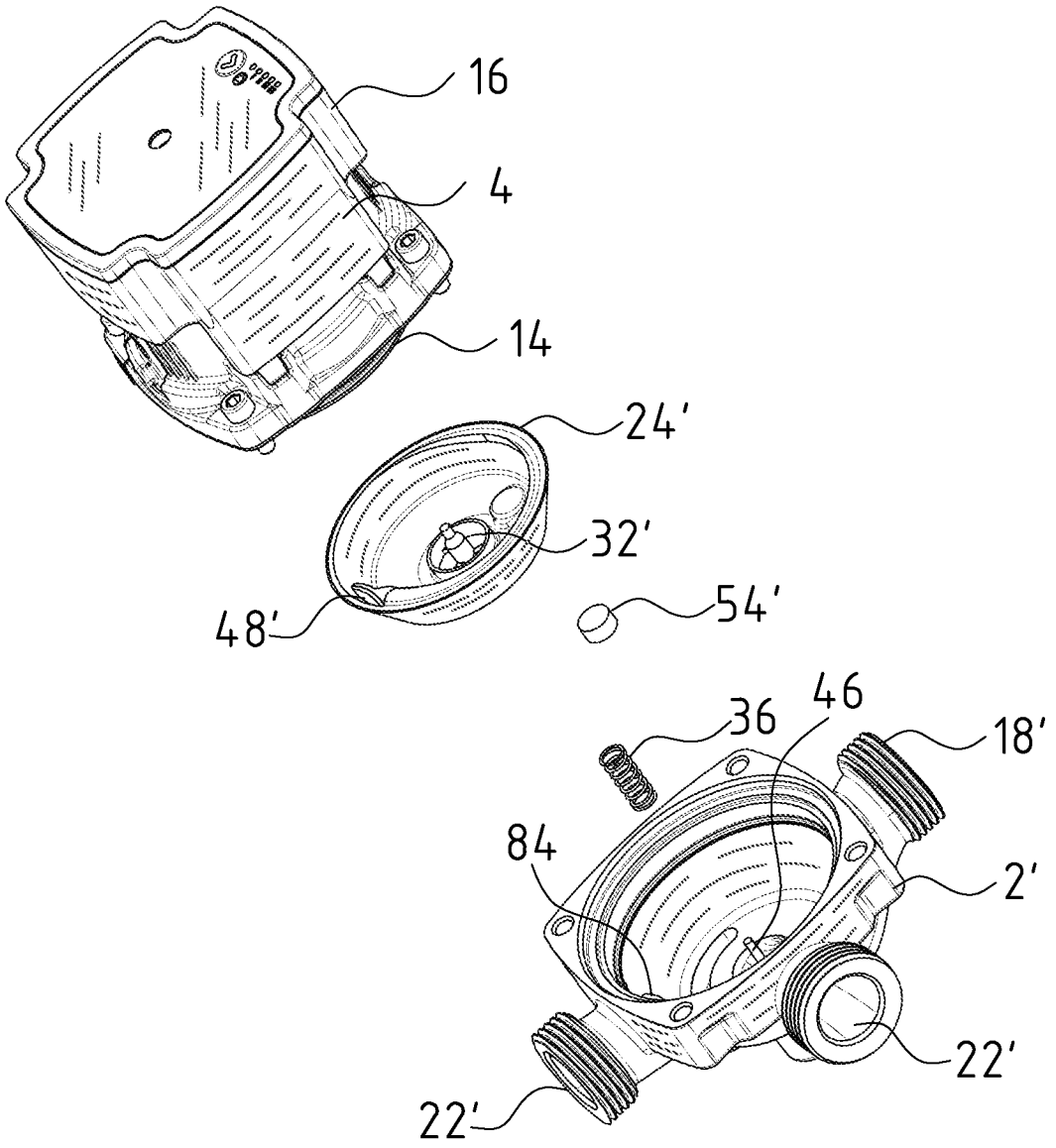
FIG. 13 is a perspective exploded view of a centrifugal pump assembly according to a second embodiment of the invention.

Concerning the previously described embodiment example, the switching-over is effected via the valve element at the suction side of the impeller 14. However, a switching-over at the delivery side could also be effected in a corresponding manner. Such an example is shown in FIG. 13. Concerning this embodiment example, the pump casing 2' comprises two delivery connections 22' and merely one suction connection 18'. The valve element 24' is configured in a pot-like manner and surrounds the impeller 14, so that the flow which is produced by the impeller 14 and the pressure which is produced by the impeller 14 acts in the inside of the valve element 24'. The valve element 24' in the inside comprises an inlet stub (branch) 32' which, as described above, is engaged with the suction port of the impeller 14. Again, a weight 54' is arranged in the valve element 24'. Moreover, the valve element 24' can be pressed by a spring 36 into a released position and be pressed into a position bearing on the pump casing 2' by the pressure in the inside of the valve element 24', against the spring force. The valve element 24' comprises a switching opening 48' in a rear wall or outer peripheral wall which in a switching position overlaps with an outlet opening 84, so that a flow path from the inside of the valve element 24' to a first of the delivery connections 22' is given. In the second switching position, the switching opening 48' is brought to overlap with a second outlet opening 84, so that a flow path is opened to the second delivery connection 22'. The switching of the valve element 24' between the switching positions is effected in the same manner as has been described above by way of the first embodiment example.

While specific embodiments of the invention have been shown and described in detail to illustrate the application of the principles of the invention, it will be understood that the invention may be embodied otherwise without departing from such principles.

The invention claimed is:

1. A centrifugal pump assembly comprising:

an electric drive motor;

an impeller which is driven by the electric drive motor;

a pump casing which surrounds the impeller;

a movable valve element arranged such that the valve element is movable between a first switching position and a second switching position by way of a flow which is produced by the impeller, wherein at least one section of the valve element is movable from a released position into a bearing position, in which the at least one section of the valve element is fixed on a contact surface, by way of pressure which is produced by the impeller in the pump casing;

a control device which is configured such that for moving the valve element from the first switching position into the second switching position, the control device reduces the speed of the drive motor and, when the pressure in the pump casing has dropped to such an extent that the valve element is no longer fixed on the contact surface and the valve element has been moved into the second switching position, the control device increases the speed of the drive motor again.

2. A centrifugal pump according to claim 1, wherein the valve element and the contact surface are configured such that in the bearing position, the valve element is prevented from a movement between the first switching position and the second switching position by way of the fixation on the contact surface, and in the released position the valve element is movable between the first switching position and the second switching position.

3. A centrifugal pump according to claim 1, wherein the control device is configured such that for moving the valve element from the first switching position into the second switching position, the control device switches off the drive motor and, when the pressure in the pump casing has dropped to such an extent that the valve element is no longer fixed on the contact surface and the valve element has been moved into the second switching position, the control device switches the drive motor on again.

4. A centrifugal pump according to claim 1, wherein the control device is configured such that the control device increases the speed of the drive motor again after a predefined time interval.

5. A centrifugal pump according to claim 1, further comprising a position sensor detecting the switching position of the valve element and signal-connected to the control device, wherein the control device is configured such that the control device increases the speed of the drive motor again when the position sensor signals that the second switching position has been reached.

6. A centrifugal pump according to claim 1, wherein the drive motor and the control device are configured such that on starting up the drive motor, the impeller produces an adequate pressure for moving the section of the valve element into the bearing position, more quickly than producing a flow for moving the valve element into to the second switching position.

7. A centrifugal pump according to claim 1, wherein the drive motor and the control device are configured such that on switching off the drive motor, the pressure which holds the section of the valve element in the bearing position reduces more quickly than a flow for moving the valve element into the second switching position.

8. A centrifugal pump according to claim 1, wherein the control device is configured such that for switching the valve element from the first switching position into the second switching position, the control device switches off the drive motor for a first predefined time interval and for switching from the second switching position into the first switching position the control device switches off the drive motor for a second predefined time interval which is longer than the first time interval.

9. A centrifugal pump according to claim 1, wherein the control device and the drive motor are configured such that the drive motor is only operable in a predefined rotation direction.

10. A centrifugal pump according to claim 1, wherein the control device and the drive motor are configured for operation of the drive motor without a speed adjustment.

11. A centrifugal pump according to claim 1, wherein the control device is configured to change a speed of the drive motor.

12. A centrifugal pump according to claim 1, wherein the pump casing comprises at least one connection and the valve element is configured such that in at least two switching positions of the valve element, the valve element opens at least one flow path through the at least one connection to a differently wide extent.

13. A centrifugal pump according to claim 12, wherein the valve element is configured such that in the first switching position, the valve element releases a flow path through a first connection and in the second switching position, the valve element releases a flow path through a second connection.

14. A centrifugal pump according to claim 1, wherein the valve element is rotatably mounted in the pump casing such that the valve element is rotatingly movable between the first and second switching positions.

15. A centrifugal pump according to claim 1, wherein the valve element comprises at least one flow engagement surface, upon which the flow which is produced by the impeller acts for moving the valve element.

16. A centrifugal pump according to claim 1, wherein the valve element comprises a restoring means configured such that given a standstill of the impeller when no flow acts upon the valve element, the restoring means moves the valve element into a predefined switching position.

17. A centrifugal pump according to claim 1, further comprising a force generating means which subjects the valve element or the at least one section of the valve element to a force to move the valve element or at least one section of the valve element out of the bearing position into the released position.

18. A centrifugal pump according to claim 1, wherein the control device comprises as least one signal input or a sensor, from which the control device receives at least one switching signal, and the control device is configured such that on receiving the switching signal, the control device controls the drive motor such that the valve element is moved from the first switching position into the second switching position.

19. A centrifugal pump according to claim 18, further comprising an electronics housing, wherein the control device is arranged in the electronics housing and the sensor for producing the switching signal is arranged in the electronics housing, wherein the sensor is a magnet sensor configured to detect a displacement of a magnetic field which is produced outside the electronics housing.

20. A method for moving a valve element which is arranged in a centrifugal pump assembly, said valve element being arranged and configured such that the valve element is movable from a first switching position into a second switching position by way of a flow which is produced by the impeller of the centrifugal pump assembly and that at least one section of the valve element is movable from a released position into a bearing position, in which the at least one section of the valve element is fixed on a contact surface, by way of pressure which is produced by the impeller, the method comprising the steps of:

reducing the speed or switching off a drive motor, by which means the pressure at the outlet side of the impeller is reduced to such an extent that the valve element or the at least one section of the valve element gets into the released position and the valve element is moved from a first switching position into a second switching position by way of the flow which is produced by the impeller;

increasing the speed or switching on the drive motor, so that the pressure at the outlet side of the impeller is increased to such an extent that the valve element or the at least one section of the valve element is moved into the bearing position.

21. A method according to claim 20, wherein the valve element in the bearing position is prevented from a movement between the first switching position and the second switching position by way of the fixation on the contact surface.

22. A method according to claim 20, wherein for moving the valve element out of the second switching position and into the first switching position, the drive motor is switched off for so long until the flow at the outlet side of the impeller has died away, so that the valve element is moved back into the first switching position by a restoring element and the drive motor is subsequently brought into operation such that pressure which moves the valve element or the at least one section of the valve element into the holding position builds up at the outlet side of the impeller, before a flow which would move the valve element into the second switching position builds up.

* * * * *